US007213479B2

(12) United States Patent
Mitsui

(10) Patent No.: US 7,213,479 B2
(45) Date of Patent: May 8, 2007

(54) VIBRATORY MECHANISM AND VIBRATORY ROLLER

(75) Inventor: Akira Mitsui, Saitama (JP)

(73) Assignee: Sakai Heavy Industries, Ltd., Tokyo (JP)

( * ) Notice: Subject to any disclaimer, the term of this patent is extended or adjusted under 35 U.S.C. 154(b) by 317 days.

(21) Appl. No.: 10/785,130

(22) Filed: Feb. 24, 2004

(65) Prior Publication Data

US 2004/0168531 A1 Sep. 2, 2004

(30) Foreign Application Priority Data

Feb. 24, 2003 (JP) ..... 2003-045857

(51) Int. Cl.
*F16H 33/10* (2006.01)

(52) U.S. Cl. ..... 74/87; 74/61

(58) Field of Classification Search ..... 74/87, 74/61; 404/117

See application file for complete search history.

(56) References Cited

U.S. PATENT DOCUMENTS 3,339,422 A * 9/1967 Petrin ..... 74/87
3,415,174 A * 12/1968 Kaltenegger ..... 404/117
3,435,741 A * 4/1969 Mozdzanowski ..... 404/117
3,598,029 A * 8/1971 Paramythioti ..... 404/117
3,920,222 A * 11/1975 Brander ..... 366/114
4,108,009 A * 8/1978 Fuchigami ..... 74/61
4,342,523 A * 8/1982 Salani ..... 404/117
4,461,122 A * 7/1984 Balz ..... 451/327
4,550,622 A * 11/1985 La Bonte et al. ..... 74/87
4,568,218 A * 2/1986 Orzal ..... 404/117
4,586,847 A 5/1986 Stanton
4,647,247 A * 3/1987 Sandstrom ..... 404/75
5,010,778 A * 4/1991 Riedl ..... 74/61
2004/0003671 A1* 1/2004 Fervers et al. ..... 74/87

* cited by examiner

*Primary Examiner*—Thomas R. Hannon
*Assistant Examiner*—Justin Krause
(74) *Attorney, Agent, or Firm*—Carrier, Blackman & Associates, P.C.; Joseph P. Carrier; William D. Blackman

(57) ABSTRACT

A vibratory mechanism includes vibratory shafts, which are stored within a roll and are arranged symmetrically across a rotation axis of the roll, fixed eccentric weights fixed to respective vibratory shafts, rotatable eccentric weights rotatably attached to respective vibratory shafts, a rotation controller controlling a range of movement of the rotatable eccentric weights, and an eccentric moment controller which changes an eccentric moment around the vibratory shaft depending on the rotation direction of the vibratory shafts, whereby the vibration state of the roll is switchable between standard vibration and horizontal vibration.

9 Claims, 5 Drawing Sheets

FIG.2A

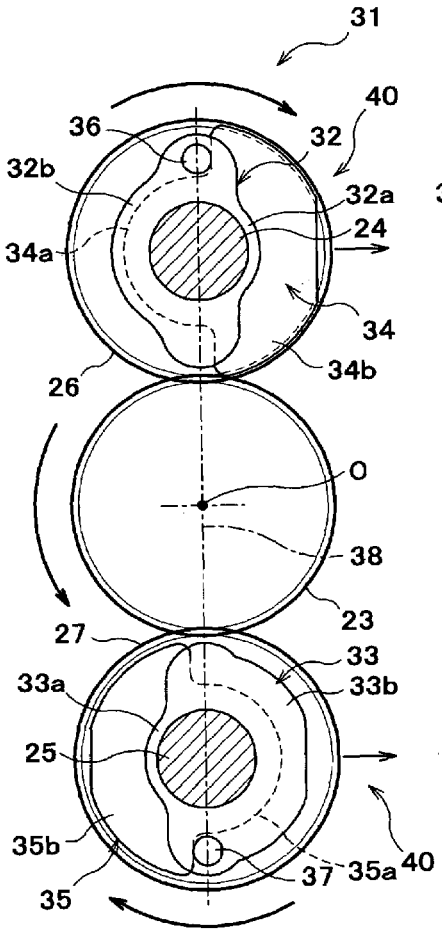

STANDARD VIBRATION $m_2r_2 - m_1r_1$:
WHOLE ECCENTRIC MOMENT AROUND THE VIBRATORY SHAFT 24 OF ECCENTRIC WEIGHTS $m_3r_3 - m_4r_4$:
WHOLE ECCENTRIC MOMENT AROUND THE VIBRATORY SHAFT 25 OF ECCENTRIC WEIGHTS

FIG.2B

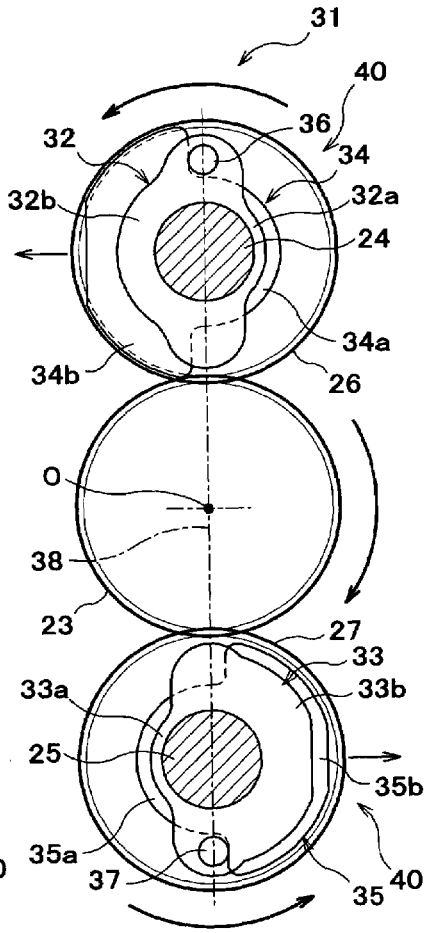

HORIZONTAL VIBRATION $m_1r_1 + m_2r_2$:
WHOLE ECCENTRIC MOMENT AROUND THE VIBRATORY SHAFT 24 OF ECCENTRIC WEIGHTS $m_3r_3 + m_4r_4$:
WHOLE ECCENTRIC MOMENT AROUND THE VIBRATORY SHAFT 25 OF ECCENTRIC WEIGHTS

FORMULA TRANSLATION $$2 \cdot mr\omega^2 \sin\omega t = M_0 \cdot \frac{d^2y}{dt^2}$$

$$\downarrow$$

$$\frac{d^2y}{dt^2} = \frac{2 \cdot mr\omega^2}{M_0} \sin\omega t$$

$$\downarrow$$

$$y = \frac{-2 \cdot mr\omega^2}{M_0\,\omega^2} \sin\omega t$$

$$\downarrow$$

$$y = \frac{-2 \cdot mr}{M_0} \sin\omega t$$

$$\downarrow$$

$$a_1 = \frac{2 \cdot mr(\text{STANDARD VIBRATION})}{M_0} \quad \text{——— (1)}$$

FIG.5

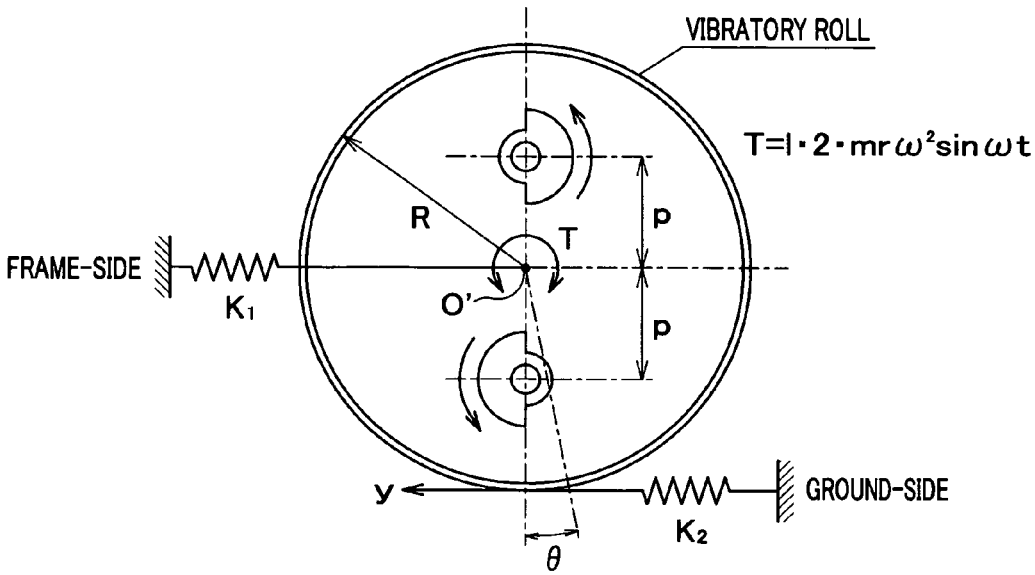

$$p \cdot 2 \cdot mr\omega^2 \sin\omega t = I\frac{d^2\theta}{dt^2}$$

$$y = R\theta$$

FORMULA TRANSLATION $$p \cdot 2 \cdot mr\omega^2 \sin\omega t = \frac{I}{R} \cdot \frac{d^2y}{dt^2}$$

$$\downarrow$$

$$\frac{d^2y}{dt^2} = \frac{R}{I} \cdot p \cdot 2 \cdot mr\omega^2 \sin\omega t$$

$$\downarrow$$

$$y = -\frac{R \cdot p \cdot 2 \cdot mr\omega^2}{I\omega^2} \sin\omega t$$

$$\downarrow$$

$$y = -\frac{R \cdot p \cdot 2 \cdot mr}{I} \sin\omega t$$

$$\downarrow$$

$$a_2 = \frac{R \cdot 2 \cdot p \cdot mr \text{ (HORIZONTAL TRANSLATION)}}{I} \quad \text{——— (2)}$$

VIBRATORY MECHANISM AND VIBRATORY ROLLER

BACKGROUND OF THE INVENTION

1. Field of the Invention

The present invention relates to a vibratory mechanism and a vibratory roller.

2. Description of the Relevant Art

A vibratory roller is mainly used for a compaction of an embankment in a construction site, such as a highway or a dam, or an asphalt pavement of a road.

The compaction using the vibratory roller is performed while vibrating a vibratory roll (roll). Thus, the ground to be compacted is densified in a very dense state. As an example of a vibratory mechanism that is provided within the vibratory roll and causes a vibration of the vibratory roll, the mechanism that causes vibration by rotating a vibratory shaft provided with an eccentric weight has been known.

Here, as an example of a vibration state of vibratory roll, two types of vibration state have been known. One is "standard vibration" which is a vibration that the vibratory roll vibrates in all radial directions thereof. The other is "horizontal vibration", which is the vibration that the vibratory roll vibrates in the direction tangential to the circumference of the vibratory roll.

In the mechanism disclosed in U.S. Pat. No. 4,647,247, is a switching unit, by which the vibration state of the vibratory roll is changed to/from the standard vibration from/to the horizontal vibration.

In FIGS. 10A and 10B of U.S. Pat. No. 4,647,247, a total of two vibratory shafts are provided within the vibratory roll. One of the vibratory shafts is provided at an opposite position across the center of the vibratory roll with respect to the other vibratory shaft. Each of the vibratory shafts is provided with an eccentric weight, and the eccentric weight of at least one of the vibratory shafts is rotatably attached to the vibratory shaft.

In this U.S. patent, if the relative phase angle between eccentric weights in case of rotation in one direction of the vibratory shaft is denoted by 0°, the relative phase angle between the eccentric weights in case of rotation in the other direction of the vibratory shaft is 180°.

When vibrating the vibratory roll under standard vibration or horizontal vibration, the vibratory roll should be vibrated at the suitable amplitude for respective vibration states.

FIG. 4 is an explanatory view showing the vibration of a vibratory roll equipped with a pair of vibratory shafts in case of standard vibration.

In this vibratory roll, an eccentric weight of the same shape is provided to respective vibratory shafts, which are rotated in accordance with a rotational torque supplied from a power supply mechanism (not shown). Thus, respective eccentric weights are rotated in the same direction at the same angular position.

In this occasion, the vibratory force directed away from the center of the vibratory roll is caused, and the direction thereof changes sequentially according to the angular position of eccentric weights. Here, if it is focused on the element vertical to a ground from among all elements of the vibratory force, and the vibratory force thereof is denoted by F, the vibratory force F is indicated by a following formula.

$$F=2\cdot m\cdot r\cdot\omega^2\cdot\sin\omega t$$

where m is a mass of an eccentric weight r is a distance between the center of the vibratory shaft and the center of gravity of the eccentric weight ω is an angular velocity of vibratory shaft.

Here, m·r is defined as eccentric moment (hereinafter m·r is indicated as "mr").

Thus, a ground can be indicated as a model of spring, which has a predetermined spring constant K and which acts in a perpendicular direction with respect to the contact surface between the vibratory roll and a ground.

When vibratory force F is periodically working on the vibratory roll whose mass is $M_0$, if spring constant K is regarded as a negligibly small value by assuming that a ground is quite loose, the equation of motion is shown by a following formula.

$$2\cdot mr\cdot\omega^2\cdot\sin\omega t=M_0\cdot d^2y/dt^2$$

where y is a displacement in ups-and-downs directions.

Then, the following formula is obtained from this formula.

$$y=(-2\cdot mr/M_0)\cdot\sin\omega t$$

Thus, the amplitude $a_1$ in the ups-and-downs directions of the vibratory roll in case of standard vibration can be shown by a following formula (1).

$$a_1=2\cdot mr(\text{standard vibration})/M_0 \quad (1)$$

In this formula, "mr (standard vibration)" means that the eccentric moment in case of standard vibration.

FIG. 5 is an explanatory view showing the vibration of a vibratory roll equipped with a pair of vibratory shafts in case of horizontal vibration.

A vibration proof rubber provided between the vibratory roll and a frame (not shown) of the vibratory roller can be indicated as a model of a spring, which has a predetermined spring constant $K_1$ and which acts in a horizontal direction with respect to a shaft center O' of the vibratory roll.

A ground can be indicated as a model of a spring, which has a predetermined spring constant $K_2$ and which acts in a horizontal direction with respect to the contact surface between the vibratory roll and a ground.

When a periodic torque T is acting on a moment of inertia I around the shaft center O' of the vibratory roll, which is supported by the spring of spring constant $K_1$ and the spring of spring constant $K_2$, the equation of motion of this case is as follows.

$$p\cdot 2\cdot mr\cdot\omega^2\cdot\sin\omega t=I\cdot d^2\theta/dt^2$$

where p is a distance between the shaft center O' of the vibratory roll and the center of the vibratory shaft.

Here, respective spring constant $K_1$ and $K_2$ are regarded as a negligibly small values by assuming respective springs are quite loose.

If the radius of the vibratory roll is denoted by R, a displacement y in a horizontal direction with respect to the contact surface between the vibratory roll and a ground can be indicated as y=R·θ, on regarding θ as a slight angular displacement. Thus, a following formula can be obtained.

$$p\cdot 2\cdot mr\cdot\omega^2\cdot\sin\omega t=(I/R)\cdot d^2y/d\,t^2$$

Then, by performing a formula translation based on y, a following formula is obtained from this formula.

$$y=-((R\cdot p\cdot 2\cdot mr)/I)\cdot\sin\omega t$$

Thus, the amplitude $a_2$ in a horizontal direction with respect to the contact surface between the vibratory roll and a ground in case of horizontal vibration can be shown by a following formula.

$$a_2 = R \cdot 2 \cdot p \cdot mr(\text{horizontal vibration})/I \quad (2)$$

In this formula (2), "mr (horizontal vibration)" means that the eccentric moment in case of horizontal vibration.

Here, a mass $M_0$ of a vibratory roll, a radius R of the vibratory roll, and a moment of inertia I around the shaft center O' of the vibratory roll are determined depending on a dimension of the vibratory roll. Therefore, it is required that the eccentric moment mr (standard vibration) can be determined freely for controlling the amplitude $a_1$ in case of standard vibration to the desired value.

Additionally, it is required that at least one of the distance p and the eccentric moment mr (horizontal vibration) can be determined freely for controlling the amplitude $a_2$ in case of horizontal vibration to the desired value. Here, the distance p is a distance between the shaft center O' of the vibratory roll and the center of the vibratory shaft.

In the vibratory roll, however, since the vibratory shaft is provided within the vibratory roll, there is a limitation of the distance p (see FIG. 5). Thus, the eccentric moment mr (horizontal vibration) has a great influence on the amplitude $a_2$ in case of horizontal vibration.

Therefore, it is preferable that the eccentric moment in case of standard vibration is different from the eccentric moment in case of horizontal vibration, for establishing the amplitude $a_1$ of standard vibration and the amplitude $a_2$ of horizontal vibration at respective suitable values.

In U.S. Pat. No. 4,647,247, as described above, a total of two vibratory shafts, each of which is provided with an eccentric weight, are stored within the vibratory roll, and the eccentric weight of one of the vibratory shafts is rotatably attached to the vibratory shaft. Therefore, the angular position between eccentric weights varies depending on the rotation direction of the vibratory shaft, but the eccentric moment in case of standard vibration is the same as the eccentric moment in case of horizontal vibration. Therefore, it has been difficult to control the amplitude of the eccentric moment to respective suitable amplitudes for the standard vibration and the horizontal vibration.

Therefore, the vibratory roller that can control the amplitude of the vibratory roll to the desired value for the standard vibration or the desired value of the horizontal vibration has been required.

SUMMARY OF THE INVENTION

The present invention relates to a vibratory mechanism. This vibratory mechanism includes vibratory shafts, which are stored within a roll and are arranged symmetrically across a rotation axis of the roll, a fixed eccentric weight fixed to respective vibratory shafts, a rotatable eccentric weight rotatably attached to respective vibratory shafts, a rotation controller controlling a range of movement of the rotatable eccentric weight, and an eccentric moment controller which changes an eccentric moment around the vibratory shafts depending on a rotation direction of the vibratory shafts.

In this vibratory mechanism, the roll vibrates in all radial directions when respective vibratory shafts rotate in one direction, and the roll vibrates in a direction tangential to the circumference of the roll when respective vibratory shafts rotate in a reverse direction.

In the vibratory mechanism, a total of two vibratory shafts, that is, a first vibratory shaft and a second vibratory shaft are stored in the roll, and the first vibratory shaft is arranged at a 180° opposite position across a rotation axis of the roll with respect to the second the vibratory shaft.

In this vibratory mechanism, a total eccentric moment around the first vibratory shaft is substantially the same as a total eccentric moment around the second vibratory shaft, when the first vibratory shaft and the second vibratory shaft are rotated in one direction. Additionally, a total eccentric moment around the first vibratory shaft is substantially the same as a total eccentric moment around the second vibratory shaft, when the first vibratory shaft and the second vibratory shaft are rotated in the reverse direction.

Here, the total eccentric moment around the first vibratory shaft is obtained by subtracting an eccentric moment of the fixed eccentric weight from an eccentric moment of the rotatable eccentric weight and the total eccentric moment around the second vibratory shaft is obtained by subtracting an eccentric moment of the rotatable eccentric weight from an eccentric moment of the fixed eccentric weight, when the first vibratory shaft and the second vibratory shaft are rotated in one direction. Additionally, the total eccentric moment around the first vibratory shaft is obtained by adding an eccentric moment of the fixed eccentric weight to an eccentric moment of the rotatable eccentric weight and the total eccentric moment around the second vibratory shaft is obtained by adding an eccentric moment of the rotatable eccentric weight to an eccentric moment of the fixed eccentric weight, when the first vibratory shaft and the second vibratory shaft are rotated in the reverse direction.

In the vibratory mechanism, respective rotatable eccentric weights of the first vibratory shaft and the second vibratory shaft are allowed to rotate around the first vibratory shaft and the second vibratory shaft, respectively, within limits of 0 to 180°. In this vibratory mechanism, the eccentric moment around the first vibratory shaft of the fixed eccentric weight is substantially the same as the eccentric moment around the second vibratory shaft of the rotatable eccentric weight, and the eccentric moment around the first vibratory shaft of the rotatable eccentric weight is substantially the same as the eccentric moment around the second vibratory shaft of the fixed eccentric weight.

The vibratory mechanism of the present invention is suitable for use in the roll of the vibratory roller.

BRIEF DESCRIPTION OF THE DRAWINGS

FIG. 2A is a sectional view along the line E—E in FIG. 1, wherein the vibratory roll is causing standard vibration.

FIG. 2B is a sectional view along a line E—E in FIG. 1, wherein the vibratory roll is causing horizontal vibration.

FIG. 5 is a schematic view used for computing amplitude of the vibratory roll in case of horizontal vibration.

DETAILED DESCRIPTION OF THE PRESENT EMBODIMENT

Figure 1:
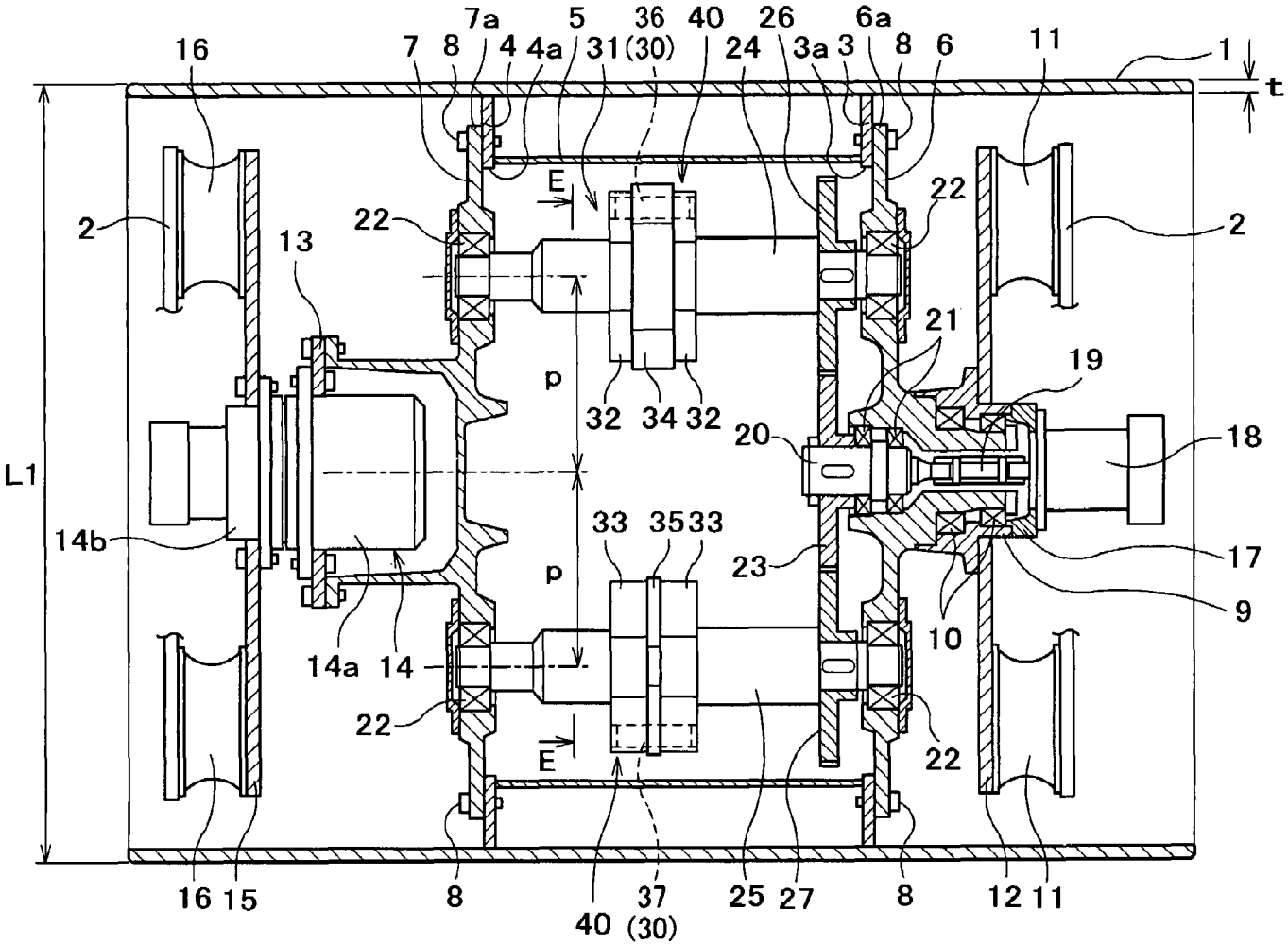
FIG. 1 is an axial sectional view of the vibratory roll equipped with a vibratory mechanism according to the present invention.

As shown in FIG. 1, a vibratory roll 1 is rotatably supported by support boards 2, which are fixed to a frame of a vibratory roller (not shown), respectively.

The vibratory roll 1 has a shape of a hollow cylinder, and a first plate 3 provided with a central aperture 3*a* and a second plate 4 provided with a central aperture 4*a* are provided therein. In this vibratory roll 1, a predetermined interval is provided between the first plate 3 and the second plate 4. A housing case 5, which stores a vibratory mechanism and has a shape of a hollow cylinder, is sandwiched between fringes of respective central apertures 3*a* and 4*a* at both sides thereof so that the housing case 5 is coaxially arranged with respect to a shaft center of the vibratory roll 1.

An axle shaft 6 is attached to the first plate 3 by fixing a flange 6*a* of the axle shaft 6 to the fringe of the first plate 3 using bolts 8. An axle shaft 7 is attached to the second plate 4 by fixing a flange 7*a* of the axle shaft 7 to the fringe of the second plate 4 using bolts 8. Thereby, the central aperture 3*a* and the central aperture 4*a* are closed by the axle shaft 6 and the axle shaft 7, respectively.

Each of the bearings 10, for example roller bearing and the like, located within a bearing-housing 9 rotatably supports the axle shaft 6 on the bearing-housing 9. The bearing-housing 9 is connected to the support board 2 through a vibration proof rubber 11 and a mounting plate 12.

The axle shaft 7 is connected to a power transmission unit 14*a* of a drive motor 14 through a mounting plate 13. A stationary part 14*b* of the drive motor 14 is fixed to the support board 2 through a mounting plate 15 and a vibration proof rubber 16. In this embodiment, a motor, such as an hydraulic motor, is used as the drive motor 14.

A reversible motor 18, which is used for generating a vibration on the vibratory roll, is connected to the bearing-housing 9, and a rotation axis thereof is connected to a gear shaft 20 through a coupling 19.

Each of bearings 21, such as roller bearings, located within the axle shaft 6 rotatably supports the gear shaft 20 so that the gear shaft 20 becomes parallel and coaxial with respect to the shaft center of the vibratory roll 1. The gear shaft 20 is provided with a drive gear 23, such as a spur gear, at an end part thereof so that the drive gear 23 is positioned within the housing case 5.

In this embodiment, a motor, such as an hydraulic motor, is used as the reversible motor 18, and the rotation axis thereof is allowed to rotate in both clockwise and anticlockwise directions.

Both ends of respective vibratory shafts 24 and 25 are supported by bearings 22, respectively, so that the vibratory shaft 24 becomes parallel with respect to the vibratory shaft 25. The vibratory shaft 24 is placed at the position opposite across the rotation shaft of the vibratory roll 1 with respect to the vibratory shaft 25.

A driven gear 26 provided on one end of vibratory shaft 24 and a driven gear 27 provided on one end of vibratory shaft 25 are engaged with the drive gear 23 of gear shaft 20. Here, the diameter of the driven gear 26 is the same as that of the driven gear 27, and the respective driven gears 26 and 27 are provided with the same number of teeth.

According to the vibratory roll 1 having these constructions, when the power transmission unit 14*a* of the drive motor 14 begins to rotate, since the axle shaft 6 is rotatably supported by the bearing-housing 9, the vibratory roll 1 begins to rotate.

In this occasion, if the reversible motor 18 is turned on and is operated, this causes the rotation of the drive gear 23. Thereby, the rotative force caused by the reversible motor 18 is transmitted to vibratory shafts 24 and 25 through driven gears 26 and 27, and causes the synchronous rotation in the same direction of vibratory shafts 24 and 25.

The vibratory mechanism 31 according to the present invention includes vibratory shafts 24 and 25, fixed eccentric weights 32 and 33, which are fixed to vibratory shafts 24 and 25, respectively, rotatable eccentric weights 34 and 35, which are rotatably attached to vibratory shafts 24 and 25, respectively, and a rotation controller 30, which is composed with stoppers 36 and 37, and which are rotated together with vibratory shafts 24 and 25 and controls the angular position of rotatable eccentric weights 34 and 35 with respect to respective fixed eccentric weights 32 and 33.

Firstly, explanations about vibratory shaft 24 will be given. The vibratory shaft 24 is provided with fixed eccentric weights 32, which are spaced apart from each other and are fixed on the vibratory shaft 24 by welding, etc.

As shown in FIGS. 2A, 2B, the fixed eccentric weight 32 is composed of an arch part 32*a* and an eccentric part 32*b*. The arch part 32*a* surrounds part of the circumference of the vibratory shaft 24 and fixed thereon. The eccentric part 32*b* having an approximately half-round shape surrounds the remainder of the circumference of the vibratory shaft 24 and is eccentrically fixed thereon.

A stopper 36 constituting the rotation controller 30 is a pole-shaped object. This stopper 36 is inserted into a through-hole provided on respective fixed eccentric weights 32 and is welded to them. Thereby, as shown in FIG. 1, the stopper 36 (shown by dot-dash line) is provided across fixed eccentric weights 32 and 32 so that the stopper 36 becomes parallel with respect to the vibratory shaft 24. This stopper 36 is fixed on respective fixed eccentric weights 32 by welding.

The rotatable eccentric weight 34 is composed of an arch part 34*a* and an eccentric part 34*b*. The arch part 34*a* surrounds part of the circumference of the vibratory shaft 24. The eccentric part 34*b* having a half-round shape surrounds the remainder of the circumference of the vibratory shaft 24 and is eccentrically attached to the vibratory shaft 24. In this embodiment, the rotatable eccentric weight 34 is mounted rotatably about the vibratory shaft 24.

A shoulder to be touched with the stopper 36 is provided at opposing ends across the vibratory shaft 24 of the eccentric part 34*b*, respectively. That is, a total of two shoulders are provided on the eccentric part 34*b*.

In the case of FIG. 2A, one of shoulders of the rotatable 20 eccentric weight 34 and the stopper 36 are in contact. Therefore, if the vibratory shaft 24 rotates anti-clockwise by 180° from this state, since the rotatable eccentric weight 34 turns around the vibratory shaft 24, the other of the shoulders comes in contact with the stopper 36.

Next, explanations about vibratory shaft 25 will be given. As can be seen from FIG. 1 through FIG. 2B, the vibratory shaft 25 has almost the same construction as the vibratory shaft 24.

That is, the vibratory shaft 25 is provided with fixed eccentric weights 33, which are spaced apart from each other. In other words, one of fixed eccentric weights 33 is fixed to the vibratory shaft 25 and is positioned apart from the other of the fixed eccentric weights 33.

As shown in FIGS. 2A, 2B, the fixed eccentric weight 33 is composed of an arch part 33*a* and an eccentric part 33*b*. The arch part 33*a* surrounds part of the circumference of the vibratory shaft 25 and is fixed thereon. The eccentric part 33*b* having an approximately half-round shape surrounds the remainder of the circumference of the vibratory shaft 25 and is eccentrically fixed thereon.

A stopper 37 constituting the rotation controller 30 is a pole-shaped object. This stopper 37 (shown by dot-dash line in FIG. 1) is inserted into a through-hole provided on respective fixed eccentric weights 33. Thereby, as shown in FIG. 1, the stopper 37 (shown by dot-dash line) is provided across fixed eccentric weights 33 and 33 so that the stopper 36 becomes parallel with respect to the vibratory shaft 25.

The rotatable eccentric weight 35 is composed of an arch part 35*a* and an eccentric part 35*b*. The arch part 35*a* surrounds part of the circumference of the vibratory shaft 25. The eccentric part 35*b* having a half-round shape surrounds the remainder of the circumference of the vibratory shaft 25 and is eccentrically attached to the vibratory shaft 25. In this embodiment, the rotatable eccentric weight 35 is mounted rotatably about the vibratory shaft 25.

A shoulder to be touched with the stopper 37 is provided at opposing-ends across the vibratory shaft 25 of the eccentric part 35*b*, respectively. That is, a total of two shoulders are provided on the eccentric part 35*b*.

In the case of FIG. 2A, one of shoulders of the rotatable eccentric weight 35 and the stopper 37 are in contact. Therefore, if the vibratory shaft 25 rotates anticlockwise by 180° from this state, since the rotatable eccentric weight 35 turns around the vibratory shaft 25, the other of the shoulders comes in contact with the stopper 37.

Here, the positional relationship between fixed eccentric weights 32 and 33 will be explained with reference to FIG. 2A, in which the vibratory shaft 24 is positioned upside with respect to the shaft center O and the vibratory shaft 25 is positioned downside with respect to the shaft center O.

In this embodiment, respective fixed eccentric weights 32 and 33 are fixed to respective vibratory shafts 24 and 25 so that the eccentric part 33*b* of the fixed eccentric weight 33 is positioned in the right side with respect to a center line 38 connecting the shaft centers of respective vibratory shafts 24 and 25, if the eccentric part 32*b* of the fixed eccentric weight 32 is positioned in the left side with respect to the center line 38.

The vibratory mechanism 31 has an eccentric moment controller 40, which changes the eccentric moment depending on the rotation direction of respective vibratory shafts 24 and 25. By providing the eccentric moment controller 40, the vibration mode of the vibratory roll 1 can be switched between "standard vibration" and "horizontal vibration".

Here, in the following explanations, a total eccentric moment around the vibratory shaft 24 that is caused by fixed eccentric weights 32 is denoted by "$m_1r_1$", an eccentric moment around the vibratory shaft 24 that is caused by the rotatable eccentric weight 34 is denoted by "$m_2r_2$", a total eccentric moment around the vibratory shaft 25 that is caused by fixed eccentric weights 33 is denoted by "$m_3r_3$", and an eccentric moment around the vibratory shaft 25 that is caused by the rotatable eccentric weight 35 is denoted by "$m_4r_4$".

Here, $m_1$, $m_2$, $m_3$, and $m_4$ are mass of respective eccentric weights, $r_1$ and $r_2$ are the distance from the center of the vibratory shaft 24 to the center of gravity of respective eccentric weights 32 and 34, and $r_3$ and $r_4$ are the distance from the center of the vibratory shaft 25 to the center of gravity of respective eccentric weights 33 and 35.

The eccentric moment due to the rotation controller 30 (the stopper 36 and the stopper 37) is vanishingly small in comparison to the eccentric moment due to respective eccentric weights. Thus, in the present embodiment, it is considered that the eccentric moment caused by the rotation controller 30 is included in the eccentric moment due to the fixed eccentric weights.

Therefore, respective eccentric moments caused by the stopper 36 and the stopper 37 are included in the eccentric moment ($m_1r_1$) caused by fixed eccentric weights 32 and the eccentric moment ($m_3r_3$) caused by fixed eccentric weights 33, respectively.

As shown in FIG. 2A, when each of vibratory shafts 24 and 25 rotates clockwise due to the anti-clockwise rotation of the drive gear 23, each of stoppers 36 and 37 rotates around the vibratory shafts 24 and 25, respectively, while pushing one of shoulders of respective rotatable eccentric weights 34 and 35.

In this case, the center of the gravity of the fixed eccentric weights 32 (33) is in the opposite side across the vibratory shaft 24 (25) with respect to the center of gravity of the rotatable eccentric weights 34 (35).

On the contrary, as shown in FIG. 2B, when each of the vibratory shafts 24 and 25 rotates anti-clockwise due to the clockwise rotation of the drive gear 23, each of stoppers 36 and 37 rotates around vibratory shafts 24 and 25, respectively, while pushing the other of shoulders of respective rotatable eccentric weights 34 and 35. That is, the angular position of the rotatable eccentric weight 34 (35) with respect to the fixed eccentric weight 32 (33) differs by 180° compared to the case of FIG. 2A.

In this case, as shown in FIG. 2B, the fixed eccentric weights 32 (33) and the rotatable eccentric weight 34 (35) are rotated in the same angular position, when the vibratory shaft 24 (25) rotates anti-clockwise. That is, the phase difference between the fixed eccentric weights 32 (33) and the rotatable eccentric weight 34 (35) is zero.

In the present embodiment, as for the vibratory shaft 24, the eccentric moment ($m_2r_2$) of the rotatable eccentric weight 34 is larger than the eccentric moment ($m_1r_1$) of the fixed eccentric weights 32, $m_2r_2>m_1r_1$. As for the vibratory shaft 25, the eccentric moment ($m_4r_4$) of the movable eccentric weight 35 is smaller than the eccentric moment ($m_3r_3$) of the fixed eccentric weights 33, $m_3r_3>m_4r_4$.

In the present embodiment, as can be seen from FIG. 1, these conditions are achieved by changing the thickness (the width in the left-and-right directions in FIG. 1) of respective eccentric weights.

In the case of FIG. 2A, the total eccentric moment to the vibratory shaft 24 of eccentric weights, that is, the eccentric moment caused by the rotatable eccentric weight 34 and fixed eccentric weights 32 is denoted by "$m_2r_2-m_1r_1$". Thus, the vibratory force directed from the vibratory shaft 24 to the right side in FIG. 1A, shown by vector, is caused.

Also, the total eccentric moment to the vibratory shaft 25 of eccentric weights, that is, the eccentric moment caused by the rotatable eccentric weight 35 and fixed eccentric weights 33 is denoted by "$m_3r_3-m_4r_4$". Thus, the vibratory force directed from the vibratory shaft 25 to the right side in FIG. 1A, shown by vector, is caused.

In the case of FIG. 2B, the total eccentric moment to the vibratory shaft 24 of eccentric weights, that is, the eccentric moment caused by the rotatable eccentric weight 34 and fixed eccentric weights 32 is denoted by "$m_1r_1+m_2r_2$". Thus, the force that makes the vibratory roll rotate in a left-side direction along the circumference of the vibratory roll is caused on the vibratory shaft 24. In other words, the force that makes the vibratory roll rotate in anticlockwise is caused on the vibratory shaft 24.

Also, the total eccentric moment to the vibratory shaft 25 of eccentric weight is denoted by "$m_3r_3+m_4r_4$". Thus, the force that makes the vibratory roll rotate in a right-side direction along the circumference of the vibratory roll is caused on the vibratory shaft 25. That is, the force that makes the vibratory roll rotate in anticlockwise is caused on the vibratory shaft 25.

In the case of FIG. 2A, if the moment around the shaft center O of the vibratory roll 1 exists, the force directed in a circumference direction with respect to the vibratory roll is applied to vibratory shafts 24 and 25. Thereby, the slight horizontal vibration is caused.

In the present embodiment, the total eccentric moment around the vibratory shaft 24 and the total eccentric moment around the vibratory shaft 25 should be established at equal value, in order to cancel the moment around the shaft center (axis) O of the vibratory roll. That is, $(m_2r_2-m_1r_1)=(m_3r_3-m_4r_4)$.

Thereby, a vibratory force directed to the same direction of the same value is caused on vibratory shafts 24 and 25, respectively.

In the present embodiment, since respective vibratory shafts 24 and 25 synchronously rotate in the same direction, the slight horizontal vibration is cancelled. But, the vibratory force due to the eccentric rotation of respective vibratory shafts that is caused in conventional vibratory roll is acting on the vibratory roll.

To be more precise, in the present embodiment, respective vibratory shafts 24 and 25 synchronously rotate in the same direction. Thus, the direction of the vibratory force to be caused from the vibratory shaft 24 becomes the same direction as the direction of the vibratory force to be caused from the vibratory shaft 25. That is, if the direction of the vibratory force to be caused from the vibratory shaft 24 is a left direction, the direction of the vibratory force to be caused from the vibratory shaft 25 is a left direction. If the direction of the vibratory force to be caused from the vibratory shaft 24 is an upper direction and a lower direction, the direction of the vibratory force to be caused from the vibratory shaft 25 is an upper direction and lower direction, respectively.

Thereby, the vibratory roll 1 receives the vibratory force, which is the sum of vibratory forces that are caused from respective vibratory shafts 24 and 25 and that have the same value, and is vibrated in 360° directions (in all radial directions).

In the case of FIG. 2B, if a resultant force of vibratory force around the shaft center (axis) O of the vibratory roll exists, the slight standard vibration is caused on the vibratory roll. The total eccentric moment around the vibratory shaft 24 is established at the same value as the total eccentric moment around the vibratory shaft 25 in order to prevent the occurrence of the standard vibration. That is, $(m_1r_1+m_2r_2)=(m_3r_3+m_4r_4)$ Thereby, if it is assumed that a ground exists in a lower-side in FIG. 2B, the horizontal force directed from left to right in figure is applied to the contact surface between the vibratory roll and a ground.

FIG. 3A through FIG. 3D illustrates eccentric weights in four different angular positions. The angular position shown in FIG. 2B is the same as that shown in FIG. 3D.

When respective vibratory shafts 24 and 25 rotate anticlockwise, each of stoppers 36 and 37 rotates around the vibratory shafts 24 and 25, respectively, while pushing one of the shoulders of respective rotatable eccentric weights 34 and 35. In this occasion, the angular position of the eccentric weights is changed in order of: FIG. 3A, FIG. 3B, FIG. 3C, and FIG. 3D. In each angular position, respective eccentric weights are rotated in the same angular position. That is, the relative phase difference of them is 0°.

Figure 3A:
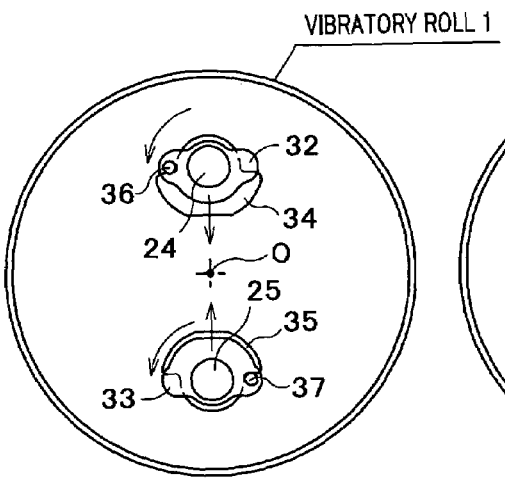
FIGS. 3A–3D are side sectional views explaining a vibratory force caused under horizontal vibration.

In the case of FIG. 3A, the force directed to the center of the vibratory roll 1 is caused on the vibratory shaft 24, and the force directed to the center of the vibratory roll 1 is also caused on the vibratory shaft 25, which is positioned in the opposite position across the shaft center O with respect to the vibratory shaft 24. Therefore, as can be seen from FIG. 3A, since these forces have the same value, these forces are canceled by each other.

Figure 3B:
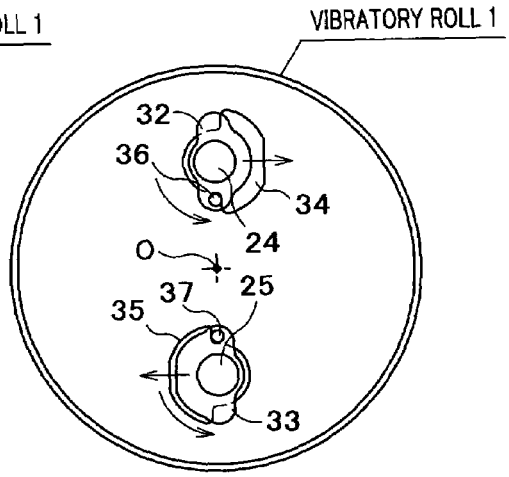

In the case of FIG. 3B, the force, which causes a rotative torque at the top of the vibratory roll that is directed in a right-side direction along the circumference of the vibratory roll, is caused on the vibratory shaft 24. On the contrary, the force, which causes a rotative torque at the bottom of the vibratory roll that is directed in a left-side direction along the circumference of the vibratory roll, is also caused on the vibratory shaft 25. That is, the force that makes the vibratory roll 1 rotate in clockwise is caused on vibratory shafts 24 and 25.

Thereby, if it is assumed that a ground exists in a lower-side in FIG. 3B, the horizontal force directed to the left side from the right side in this figure is applied to the contact surface between the vibratory roll 1 and a ground.

Figure 3C:
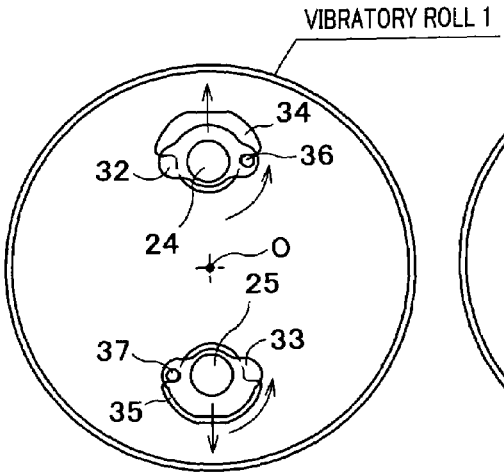

In the case of FIG. 3C, the force directed away from the center of the vibratory roll 1 is applied to the vibratory shaft 24, and the force directed away from the center of the vibratory roll 1 is applied to the vibratory shaft 25. Thereby, these forces are canceled by each other.

Figure 3D:
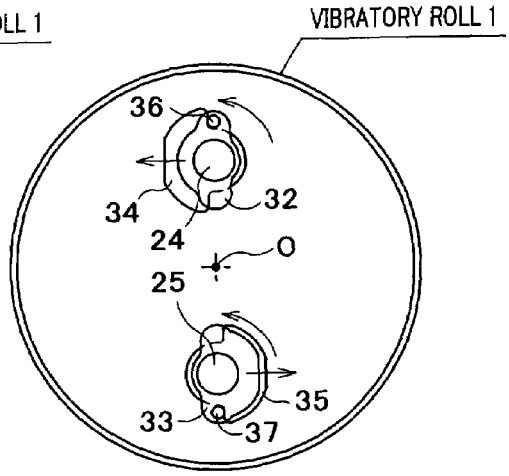
Figure 4:
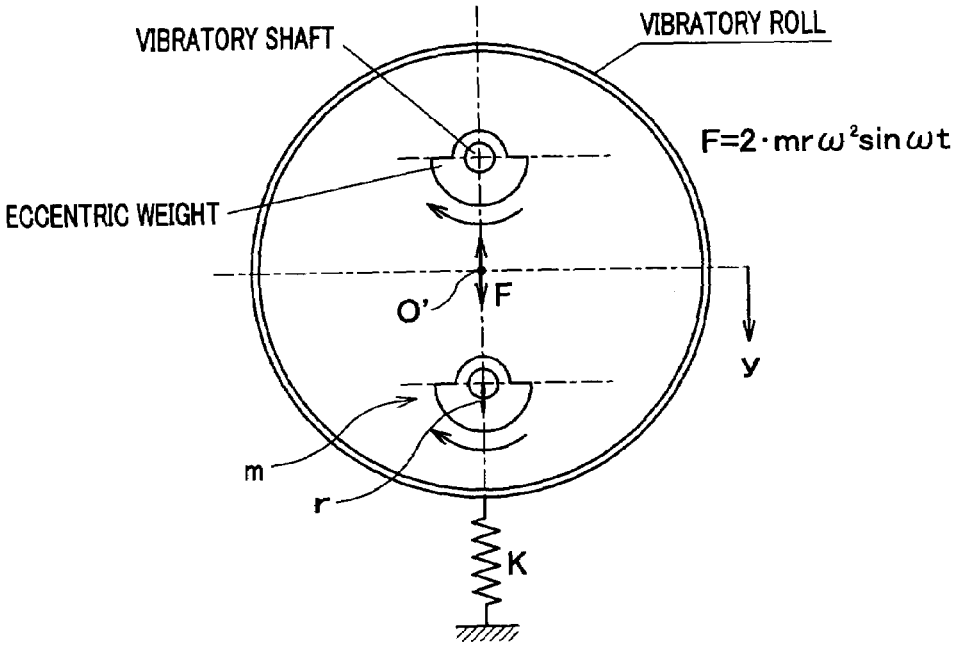
FIG. 4 is a schematic view used for computing amplitude of the vibratory roll in case of standard vibration.

In the case of FIG. 3D, the force, which causes a rotative torque at the top of the vibratory roll 1 that is directed in a left-side direction along the circumference of the vibratory roll 1, is caused on the vibratory shaft 24. On the contrary, the force, which causes a rotative torque at the bottom of the vibratory roll that is directed in a right-side direction along the circumference of the vibratory roll, is also caused on the vibratory shaft 25. That is, the force that makes the vibratory roll 1 rotate in anticlockwise is caused on vibratory shafts 24 and 25.

Thereby, if it is assumed that a ground exists in a lower-side in FIG. 3D, the horizontal force directed to the right side from the left side in this figure is applied to the contact surface between the vibratory roll 1 and a ground.

Therefore, since the relative position between the eccentric weights of FIG. 3B and that of FIG. 3D are repeated alternately, the torque directed in a horizontal direction is applied to the contact surface between the vibratory roll 1 and a ground.

Therefore, the relation of eccentric moments is denoted by the following formula (3) and formula (4).

$$m_2r_2-m_1r_1=m_3r_3-m_4r_4 \tag{3}$$

$$m_1r_1+m_2r_2=m_3r_3+m_4r_4 \tag{4}$$

Based on these formulas (3) and (4), following formulas are obtained.

$$m_2r_2=m_3r_3 \tag{5}$$

$$m_1r_1=m_4r_4 \tag{6}$$

That is, the eccentric moment of the rotatable eccentric weight 34 and that of the fixed eccentric weight 33 are equal (see formula (5)). Additionally, the eccentric moment of the fixed eccentric weight 32 and that of the rotatable eccentric weight 35 are equal (see formula (6)).

In the present embodiment, if the total eccentric moment around the vibratory shaft 24 in case of rotation in one direction of the vibratory shaft 24 (in case of standard vibration) is denoted by "$m_2r_2-m_1r_1$" and the total eccentric moment around the vibratory shaft 24 in case of rotation in the other direction of the vibratory shaft 24 (in case of horizontal vibration) is denoted by "$m_1r_1+m_2r_2$", this greatly expands the possibility of the selection of the amplitude of the vibratory roll. This is because of following-reasons.

Here, if the total eccentric moment around the vibratory shaft 24 in case of standard vibration is denoted by "mr (standard vibration)" instead of "$m_2r_2-m_1r_1$" and the total eccentric moment around the vibratory shaft 24 in case of horizontal vibration is denoted by "mr (horizontal vibration)" instead of "$m_1r_1+m_2r_2$", the following formulas can be obtained.

$$m_2r_2=(mr(\text{standard vibration})+mr(\text{horizontal vibration}))/2 \quad (7)$$

$$m_1r_1=(mr(\text{standard vibration})-mr(\text{horizontal vibration}))/2 \quad (8)$$

EXAMPLE

As for FIG. 1, if it is assumed that the vibratory roll has a dimension of 1 meter and has about 15 millimeters (hereinafter indicated as "mm") thickness, the drum weights $M_0$ is about 720 kg and the eccentric moment around center axis O of the vibratory roll 1 is about 155 $kgm^2$.

Here, if the amplitude $a_1$ in the ups-and-downs directions of the vibratory roll 1 in case of operation of the vibratory roll under the standard vibration is determined as 0.3 mm, which corresponds to one of suitable amplitude for the compaction of the asphalt mixture, a following formula is obtained from formula (1).

$$0.0003=(2\times mr(\text{standard vibration}))/720 \therefore mr(\text{standard vibration})=(0.0003\times 720)/2=0.11$$

Thus, 0.11 kgm is obtained as the value of mr(standard vibration).

In the case of U.S. Pat. No. 4,647,247, the eccentric moment around the vibratory shaft caused by the eccentric weight in case of standard vibration is the same as that in case of the horizontal vibration. Thus, the value of mr(horizontal vibration) is the same as the value of mr(standard vibration). Thereby, the value of 0.11 kgm is also the value of mr(horizontal vibration).

Then, if the distance between the rotational axis O of the vibratory roll 1 and the respective vibratory shafts 24 and 25 is denoted by "p", since the maximum (limit) value of p is 0.25 m due to the limitation in the size of the vibratory roll 1, the amplitude $a_2$ in case of horizontal vibration is obtained from formula (2).

$$a_2=(0.5\times 2\times 0.25\times 0.11)/155=0.18 \text{ mm}$$

That is, the value of $a_2$ is 0.18 mm.

Generally, the amplitude $a_2$ suitable for the compaction of asphalt mixture under horizontal vibration is about 0.5 mm. But, in the case of the vibratory roll disclosed in U.S. Pat. No. 4,647,247, since limit of the amplitude $a_2$ of the vibratory roll is 0.18 mm, the amplitude suitable for horizontal vibration of the vibratory roll is not obtained.

In the present invention, on the contrary, the value of mr in case of horizontal vibration differs from the value in case of standard vibration. If the amplitude $a_2$ in case of horizontal vibration is determined as 0.5 mm, mr(horizontal vibration)=0.31 kgm is obtained from formula (2).

$$0.0005=(0.5\times 2\times 0.25\times mr(\text{horizontal vibration}))/155 \therefore mr(\text{horizontal vibration}))=0.31 \text{ kg·m}$$

Thus, the eccentric moment ($m_2r_2$) around the vibratory shaft 24 of the rotatable eccentric weight 34 is computed from formula (7) based on these computed values. That is, $m_2r_2=(0.11+0.31)/2=0.21$ kg·m. Additionally, the eccentric moment ($m_1r_1$) around the vibratory shaft 24 of the fixed eccentric weight 32 is computed from formula (8) based on these computed values. That is, $m_1r_1=(0.31-0.11)/2=0.10$ kg·m.

Accordingly, the eccentric moment ($m_2r_2$) around the vibratory shaft 24 of the rotatable eccentric weight 34 is 0.21 kgm. The eccentric moment ($m_1r_1$) around the vibratory shaft 24 of the fixed eccentric weight 32 is 0.10 kgm.

Here, as can be seen from formula (5) and formula (6), if the eccentric moment $m_2r_2$ around the vibratory shaft 24 of the rotatable eccentric weight 34 and the eccentric moment $m_3r_3$ around the vibratory shaft 25 of the fixed eccentric weight 33 are set at 0.21 kgm and if the eccentric moment $m_1r_1$ around the vibratory shaft 24 of the fixed eccentric weight 32 and the eccentric moment $m_4r_4$ around the vibratory shaft 25 of the rotatable eccentric weight 35 are set at 0.10 kgm, the amplitude of 0.3 mm suitable for standard vibration and amplitude of 0.5 mm suitable for horizontal vibration are obtained.

In other words, if the eccentric moment $m_2r_2$ and the eccentric moment $m_3r_3$ are 0.21 kgm and the eccentric moment $m_1r_1$ and the eccentric moment $m_4r_4$ are 0.10 kgm, 0.3 mm and 0.5 mm are computed using formula (5) and the formula (6) as the amplitude suitable for standard vibration and the amplitude suitable for horizontal vibration, respectively.

In the present invention, as described above, the vibratory mechanism includes vibratory shafts, which are stored within a roll and are arranged symmetrically across a rotation axis of the roll (vibratory roll), a fixed eccentric weight fixed to respective vibratory shafts, a rotatable eccentric weight rotatably attached to respective vibratory shafts, a rotation controller controlling a range of movement of the rotatable eccentric weight, and an eccentric moment controller which changes an eccentric moment around the vibratory shaft depending on a rotation direction of the vibratory shafts.

According to this vibratory mechanism having these constructions, the roll vibrates in all radial directions when respective vibratory shafts rotate in one direction, and the roll vibrates in a direction tangential to the circumference of the roll when respective vibratory shafts rotate in the reverse direction. Thereby, the amplitude of the vibratory roller can be controlled for the use in standard vibration or horizontal vibration.

In the present invention, as described above, a first vibratory shaft 24 and a second vibratory shaft 25 are stored in the roll (vibratory roll 1), and the first vibratory shaft 24 is arranged at 180° opposite position across a rotation axis O of the roll 1 with respect to the second vibratory shaft 25.

In this occasion, a total eccentric moment around the first vibratory shaft 24 is substantially the same as a total eccentric moment around the second vibratory shaft 25, when the first vibratory shaft 24 and the second vibratory shaft 25 are rotated in one direction (for example, anti-clockwise), and a total eccentric moment around the first vibratory shaft 24 is substantially the same as a total eccentric moment around the second vibratory shaft 25, when the first vibratory shaft 24 and the second vibratory shaft 25 are rotated in the reverse direction (for example, clockwise).

Here, the total eccentric moment around the first vibratory shaft 24 is obtained by subtracting an eccentric moment ($m_1r_1$) of fixed eccentric weights 32 from an eccentric moment ($m_2r_2$) of rotatable eccentric weight 34 and the total eccentric moment around the second vibratory shaft 25 is obtained by subtracting an eccentric moment ($m_4r_4$) of rotatable eccentric weight 35 from an eccentric moment ($m_3r_3$) of fixed eccentric weights 33, when the first vibratory shaft 24 and the second vibratory shaft 25 are rotated in one direction (for example, anti-clockwise), and the total eccentric moment around the first vibratory shaft 24 is obtained by adding an eccentric moment of fixed eccentric weights 32 to an eccentric moment of rotatable eccentric weight 34 and the total eccentric moment around the second vibratory shaft 25 is obtained by adding an eccentric moment of rotatable eccentric weight 35 to an eccentric moment of fixed eccentric weights 33 when the first vibratory shaft 24 and the second vibratory shaft 25 are rotated in the reverse direction (for example, clockwise).

According to the vibratory mechanism having these constructions, the switching of the amplitude of the vibratory roll equipped with a pair of vibratory shafts can be achieved with simple construction. Thereby, amplitude suitable for standard vibration and amplitude suitable for horizontal vibration can be selected.

As an example of the movable eccentric weight, the mechanism disclosed in Japanese Unexamined Patent publication No. S61-40905 (equivalent to U.S. Pat. No. 4,586,847) can be cited. In this patent publication, the vibratory roll, in which inner walls and liquidity weights are provided, is disclosed. In this vibratory roll, liquidity weights, which are stored in the vibratory roll and which move along the inside-circumference of the roll when the vibratory roll is rotated, correspond to the rotatable eccentric weight. Inner walls which restrict the range of the movement of the liquidity weights correspond to the rotation controller.

In the present invention, as described above, respective rotatable eccentric weights 34 and 35 of the first vibratory shaft 24 and the second vibratory shaft 25 are allowed to rotate around the first vibratory shaft 24 and the second vibratory shaft 25, respectively, within limits of 0 to 180°.

Here, the eccentric moment $m_1r_1$ around the first vibratory shaft 24 of the fixed eccentric weights 32 is substantially the same as the eccentric moment $m_4r_4$ around the second vibratory shaft 25 of the rotatable weight 35, and the eccentric moment $m_2r_2$ around the first vibratory shaft 24 of the rotatable eccentric weight 34 is substantially the same as the eccentric moment m3r3 around the second vibratory shaft 25 of the fixed eccentric weights 33.

According to the vibratory mechanism having these constructions, the design of rotatable eccentric weights 34 and 35 can be achieved with ease. Thereby, amplitude suitable for standard vibration and amplitude suitable for horizontal vibration can be selected.

If the vibratory roll equipped with the vibratory mechanism according to the present invention is adopted by the vibratory roller, the vibratory roller, which can meet various needs of compaction operation, can be obtained. This is because the amplitude of the vibratory roll can be adjusted to the suitable value for standard vibration and horizontal vibration.

Here, the vibration of the vibratory roll between standard vibration and horizontal vibration can be suitably changed depending on a quality (condition) of the ground to be compacted.

In the above described embodiment, a total of two vibratory shafts are provided within the vibratory roll. But the numbers of the vibratory shaft is not restricted to this. For example, the vibratory roll which includes a total of four vibratory shafts may be adoptable. In this vibratory roll, vibratory rolls having the same construction are provided around the rotation shaft of the vibratory roll at a phase difference of 90°.

In the present invention, additionally, each of the fixed eccentric weights is provided separately from the vibratory roll. But these fixed eccentric weights may be provided as a single unit with the corresponding vibratory shafts.

According to the present invention, since the amplitude of the vibratory roll can be controlled to the suitable value for standard vibration and horizontal vibration, the satisfactory compaction result can be obtained.

Although there have been disclosed what is the present embodiment of the invention, it will be understood by persons skilled in the art that variations and modifications may be made thereto without departing from the scope of the invention, which is indicated by the appended claims.

What is claimed is:

1. A vibratory mechanism comprising:

first and second vibratory shafts, which are stored within a roll and are arranged symmetrically across a rotation axis of the roll, and are rotated in a same direction during operation of said mechanism;

fixed eccentric weights fixed to respective ones of the first and second vibratory shafts;

rotatable eccentric weights rotatably attached to respective ones of the first and second vibratory shafts;

rotation controllers controlling a range of movement of the rotatable eccentric weights; and an eccentric moment controller which changes an eccentric moment around the first and second vibratory shafts depending on a rotation direction of the first and second vibratory shafts, whereby the roll vibrates in all radial directions when the first and second vibratory shafts rotate in one direction, and the roll vibrates in a direction tangential to the circumference of the roll when the first and second vibratory shafts rotate in a reverse direction, wherein a total eccentric moment around the first vibratory shaft is substantially the same as a total eccentric moment around the second vibratory shaft when the first vibratory shaft and the second vibratory shaft are rotated in the one direction, a total eccentric moment around the first vibratory shaft is substantially the same as a total eccentric moment around the second vibratory shaft when the first vibratory shaft and the second vibratory shaft are rotated in the reverse direction, wherein the total eccentric moment around the first vibratory shaft is obtained by subtracting an eccentric moment of the fixed eccentric weight from an eccentric moment of the rotatable eccentric weights and the total eccentric moment around the second vibratory shaft is obtained by subtracting an eccentric moment of the rotatable eccentric weights from an eccentric moment of the fixed eccentric weight, when the first vibratory shaft and the second vibratory shaft are rotated in the one direction, and the total eccentric moment around the first vibratory shaft is obtained by adding an eccentric moment of the fixed eccentric weight to an eccentric moment of the rotatable eccentric weights and the total eccentric moment around the second vibratory shaft is obtained by adding an eccentric moment of the rotatable eccentric weights to an eccentric moment of the fixed eccentric weight, when the first vibratory shaft and the second vibratory shaft are rotated in the reverse direction.

2. A vibratory mechanism according to claim 1, wherein respective rotatable eccentric weights of the first vibratory shaft and the second vibratory shaft are allowed to rotate around the first vibratory shaft and the second vibratory shaft, respectively, within limits of 0 to 180°, the eccentric moment around the first vibratory shaft of the fixed eccentric weight is substantially the same as the eccentric moment around the second vibratory shaft of the rotatable eccentric weight, and the eccentric moment around the first vibratory shaft of the rotatable eccentric weight is substantially the same as the eccentric moment around the second vibratory shaft of the fixed eccentric weight.

3. A vibratory roller having a vibratory mechanism of claim 1 in a roll.

4. A vibratory mechanism according to claim 1, wherein said fixed eccentric weight fixed to the second vibratory shaft is heavier than said rotatable eccentric weight rotatably attached to the second vibratory shaft, and said fixed eccentric weight fixed to first the vibratory shaft is lighter than said rotatable eccentric weight rotatably attached to the first vibratory shaft.

5. A vibratory mechanism according to claim 1, wherein said fixed eccentric weight fixed to second the vibratory shaft is larger in size than said rotatable eccentric weight rotatably attached to the second vibratory shaft, and said fixed eccentric weight fixed to the first vibratory shaft is smaller in size than said rotatable eccentric weight rotatably attached to the first vibratory shaft.

6. A vibratory mechanism comprising:

a first vibratory shaft and a second vibratory shaft, which are stored within a roll and are arranged symmetrically across a rotation axis of the roll, and the first vibratory shaft and the second vibratory shaft are rotated in the same direction during operation of said mechanism;

a first fixed eccentric weight and a second fixed eccentric weight, which are fixed to the first vibratory shaft and the second vibratory shaft, respectively;

a first rotatable eccentric weight and a second rotatable eccentric weight, which are rotatably attached to the first vibratory shaft and the second vibratory shaft, respectively;

a first rotation controller, which is provided on the first fixed eccentric weight and controls a first phase difference between the first fixed eccentric weight and the first rotatable eccentric weight depending on the rotation direction of the first vibratory shaft; and a second rotation controller, which is provided on the second fixed eccentric weight and controls a second phase difference between the second fixed eccentric weight and the second rotatable eccentric weight depending on the rotation direction of the second vibratory shaft, wherein an eccentric moment to the first vibratory shaft of the first fixed eccentric weight is substantially the same as an eccentric moment to the second vibratory shaft of the second rotatable eccentric weight, and an eccentric moment to the first vibratory shaft of the first rotatable eccentric weight is substantially the same as an eccentric moment to the second vibratory shaft of the second fixed eccentric weight, and wherein the first rotatable eccentric weight and the second rotatable eccentric weight are asymmetrically located across the rotation of the roll.

7. A vibratory mechanism according to claim 6, wherein the first rotation controller and the second rotation controller hold the first phase difference and the second phase difference at 0°, respectively, when the first vibratory shaft and the second vibratory shaft rotate in one direction, and the first rotation controller and the second rotation controller hold the first phase difference and the second phase difference at 180°, respectively, when the first vibratory shaft and the second vibratory shaft rotate in a reverse direction.

8. A vibratory mechanism according to claim 6, wherein said fixed eccentric weight fixed to the first vibratory shaft is larger in size than said rotatable eccentric weight rotatably attached to the first vibratory shaft, and said fixed eccentric weight fixed to the second vibratory shaft is smaller in size than said rotatable eccentric weight rotatably attached to the second vibratory shaft.

9. A vibratory mechanism according to claim 6, wherein said fixed eccentric weight fixed to the first vibratory shaft is heavier than said rotatable eccentric weight rotatably attached to the first vibratory shaft, and said fixed eccentric weight fixed to the second vibratory shaft is lighter than said rotatable eccentric weight rotatably attached to the second vibratory shaft.

* * * * *

UNITED STATES PATENT AND TRADEMARK OFFICE

CERTIFICATE OF CORRECTION

PATENT NO. : 7,213,479 B2
APPLICATION NO. : 10/785130
DATED : May 8, 2007
INVENTOR(S) : Mitsui It is certified that error appears in the above-identified patent and that said Letters Patent is hereby corrected as shown below:

Column 2:
Line 20, change "ups-and-downs" to -- up-and-down --.
Line 25, change "ups-and-downs" to -- up-and-down --.
Line 35, change "A vibration proof" to --A vibration-proof--.
Line 55, change "constant $K_1$ and $K_2$ are" to --constants $K_1$ and $K_2$ are--.
Line 56, change "a negligibly small values" to --negligibly small values--.

Column 4:
Line 2, change "the second the vibratory" to --the second vibratory--.

Column 5:
Lines 23-24, change "vibration proof rubber" to --vibration-proof rubber--.
Lines 24-25, change "such as an hydraulic" to --such as a hydraulic--.
Line 30, change "Each of bearings" to --Each of the bearings--.
Line 37, change "such as an hydraulic" to --such as a hydraulic--.

Column 6:
Line 39, change "one of shoulders" to --one of the shoulders--.
Line 40, change "20 eccentric weight" to --eccentric weight--.
Line 41, change "anti-clockwise" to --anticlockwise--.
Line 51, change "one of fixed" to --one of the fixed--.

Column 7:
Line 10, change "at opposing-ends across" to --at opposing ends across--.
Line 13, change "one of shoulders" to --one of the shoulders--.
Line 67, change "anti-clockwise" to --anticlockwise--.

Column 8:
Line 3, change "one of shoulders" to --one of the shoulders--.
Line 5, change "the center of the gravity" to --the center of gravity--.
Line 10, change "anti-clockwise" to --anticlockwise--.
Line 13, change "the other of shoulders" to --the other of the shoulders--.
Line 21, change "anti-clockwise" to --anticlockwise--.
Line 54, change "rotate in anticlockwise" to --rotate anticlockwise--.
Line 61, change "rotate in anticlockwise" to --rotate anticlockwise--.

UNITED STATES PATENT AND TRADEMARK OFFICE

CERTIFICATE OF CORRECTION

PATENT NO. : 7,213,479 B2
APPLICATION NO. : 10/785130
DATED : May 8, 2007
INVENTOR(S) : Mitsui It is certified that error appears in the above-identified patent and that said Letters Patent is hereby corrected as shown below:

Column 9:

Line 42, after "($m_3r_3+m_4r_4$)" insert a period.

Line 44, change "lower-side" to --lower side--.

Line 48, change "FIG.3A through FIG. 3D illustrates" to --FIG.3A through FIG. 3D illustrate--.

Line 59, change "difference of them" to --difference between them--.

Column 10:

Line 9, change "rotate in clockwise" to --rotate clockwise--.

Line 12, change "lower-side" to --lower side--.

Line 28, change "rotate in anticlockwise" to --rotate anticlockwise--.

Line 31, change "lower-side" to --lower side--.

Line 64, change "because of following-reasons." to --because of the following reasons. --.

Column 11:

Line 15, change "the drum weights" to --the drum weight--.

Line 18, change "ups-and-downs directions" to -- up-and-down directions--.

Line 25, delete "$\therefore mr$(stan-".

Line 26, change "dard" to --$\therefore$ mr(standard--.

Line 57, change "(horizontal vibration))/" to --(horizontal vibration))/155--.

Line 58, delete "155"; change "vibration))=0.31" to --vibration)= 0.31--.

Column 12:

Line 67, change "anti-clockwise" to --anticlockwise--.

Column 13:

Line 23, change "inside-circumference" to --inside circumference--.

Line 38, change "eccentric moment m3r3" to --eccentric moment $m_3r_3$--.

Line 58, change "numbers of the vibratory shaft" to --numbers of vibratory shafts--.

Column 14:

Line 5, change "Although there have" to --Although there has--.

Column 15:

Line 13, change "fixed to first the" to --fixed to the first--.

Line 17, change "fixed to second the" to --fixed to the second--.

UNITED STATES PATENT AND TRADEMARK OFFICE

CERTIFICATE OF CORRECTION

PATENT NO. : 7,213,479 B2
APPLICATION NO. : 10/785130
DATED : May 8, 2007
INVENTOR(S) : Mitsui It is certified that error appears in the above-identified patent and that said Letters Patent is hereby corrected as shown below:

Column 16:

Line 14, change "are asymmetrically located" to --are axisymmetrically located--.

Signed and Sealed this

Fourteenth Day of August, 2007

JON W. DUDAS
*Director of the United States Patent and Trademark Office*